United States Patent [19]

Hibino et al.

[11] Patent Number: 4,786,195

[45] **Date of Patent: * Nov. 22, 1988**

[54] ERASING MEANS FOR THERMAL TRANSFER PRINTER

[75] Inventors: Ikuo Hibino, Takizawa; Tadashi Nakamura, Morioka; Koichi Umeki, Tamayama, all of Japan

[73] Assignee: Alps Electric Co., Ltd., Japan

[ * ] Notice: The portion of the term of this patent subsequent to Mar. 31, 2004 has been disclaimed.

[21] Appl. No.: 858,943

[22] Filed: May 2, 1986

[30] Foreign Application Priority Data

May 2, 1985 [JP] Japan ..... 60-93576

[51] Int. Cl.[4] ..... B41J 29/373

[52] U.S. Cl. ..... 400/696; 400/120; 400/208; 400/697.1; 400/82

[58] Field of Search ..... 400/82, 120, 194, 195, 400/196, 196.1, 207, 208, 208.1, 214, 696, 697, 697.1

[56] References Cited

U.S. PATENT DOCUMENTS

| | | | |
|---|---|---|---|
| 4,396,308 | 8/1983 | Applegate et al. | 400/696 |
| 4,403,874 | 9/1983 | Payne et al. | 400/196.1 X |
| 4,429,318 | 1/1984 | Kobata | 400/697.1 X |
| 4,453,167 | 6/1984 | Motoyoshi | 400/120 X |
| 4,504,160 | 3/1985 | Payne et al. | 400/196.1 |
| 4,639,880 | 1/1987 | Yasuhiro | 400/82 X |
| 4,651,162 | 3/1987 | Nakamura et al. | 400/696 X |
| 4,654,674 | 3/1987 | Hibino et al. | 400/120 X |
| 4,661,003 | 4/1987 | Okamori | 400/82 X |

FOREIGN PATENT DOCUMENTS

| | | | |
|---|---|---|---|
| 0055258 | 4/1983 | Japan | 400/82 |
| 0124687 | 7/1983 | Japan | 400/120 |
| 0184674 | 10/1984 | Japan | 400/120 |
| 0097873 | 5/1985 | Japan | 400/120 |
| 0210467 | 10/1985 | Japan | 400/120 |
| 0210468 | 10/1985 | Japan | 400/82 |
| 0245580 | 12/1985 | Japan | 400/697.1 |

*Primary Examiner*—Ernest T. Wright, Jr.

*Attorney, Agent, or Firm*—Guy W. Shoup; Paul J. Winters

[57] ABSTRACT

A thermal transfer printer which can simply and assuredly erase a symbol recorded in error with thermal transfer ink on record paper. The printer comprises, in addition to a printing transfer ribbon and a printing thermal head, an erasing ribbon carrying thereon a layer of a thermally adhesive resin material, and an erasing thermal head which is operated, during erasing operation, to generate heat to melt the thermally adhesive resin on said erasing ribbon sufficient to adhere to the thermally fusible ink of a symbol printed on record paper so that the ink may be removed from the paper as the erasing ribbon is moved away from the record paper. The printing and erasing thermal heads are mounted in a juxtaposed relationship on a movable carriage, and the erasing thermal head has a greater heat generating area than the printing thermal head.

3 Claims, 2 Drawing Sheets

ERASING MEANS FOR THERMAL TRANSFER PRINTER

BACKGROUND OF THE INVENTION

This invention relates to a thermal transfer printer which is suitable for use with a word processor, a typewriter and so on.

A thermal transfer printer is conventionally provided with a thermal transfer ribbon carrying a layer of reversible, thermally fusible ink is put between record paper and a thermal head. The thermal head generates heat which melts ink on the thermal transfer ribbon to effect transfer recording of characters, marks and the like on the record paper.

In recent years, thermal transfer printers of this type have been widely used as output devices for business machines, and they are being applied, for example, to word processors, electronic typewriters and so on. Such word processors and typewriters are required to have a function to correct characters, makrs and the like recorded in error on record paper. However, in conventional thermal transfer printers, it is difficult to delete or erase characters, marks and the like once printed in error on record paper by transfer of ink. Accordingly, in case of printing in error, either a symbol printed in error must be corrected by hand writing or the record paper must be replaced. This may often cause trouble in that a corrected portion is soiled or will lead to a problem in that correcting operations are troublesome.

SUMMARY OF THE INVENTION

It is an object of the present invention to provide a thermal transfer printer which can simply and assuredly erase symbols such as characters and marks recorded in error on record paper.

According to the invention, there is provided a thermal transfer printer which comprises, a printing transfer ribbon which carries a layer of thermally fusible ink thereon, and a printing thermal head mounted on a movable carriage and operable to generate heat to melt the thermally fusible ink on the transfer ribbon to effect transfer recording on record paper. The transfer printer also includes, an erasing ribbon carrying thereon a layer of a thermally adhesive resin material for lifting off the thermally fusible ink of a symbol printed in error on the record paper, and an erasing themal head mounted on said carriage which has a heat generating area greater than that of the printing thermal head. The erasing thermal head and the printing thermal head are disposed in a juxtaposed relationship in the direction of carriage movement. During normal recording, the printing thermal head generates heat which melts the thermally fusible ink on the printing transfer ribbon to effect desired printing by transfer of the ink. Similarly, the erasing thermal head generates heat to melt the thermally adhesive resin on the erasing ribbon for adherence to the thermally fusible ink of symbols printed in error to lift-off the ink from the record paper.

DETAILED DESCRIPTION OF THE INVENTION

A preferred embodiment of the present invention will be described below with reference tot he accompanying drawings.

Figure 1:
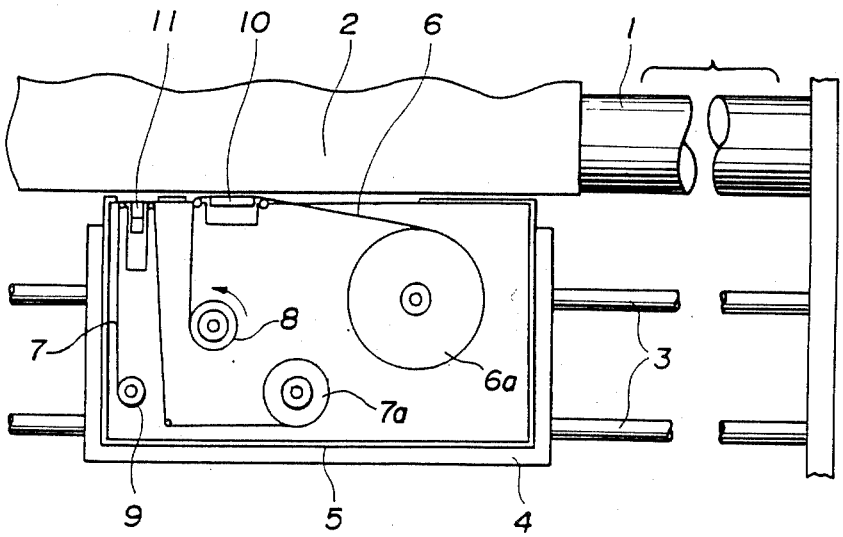
FIG. 1 is a schematic plan view of a thermal transfer printer according to an embodiment of the present invention, illustrating a printing thermal head in its operative position.
Figure 2:
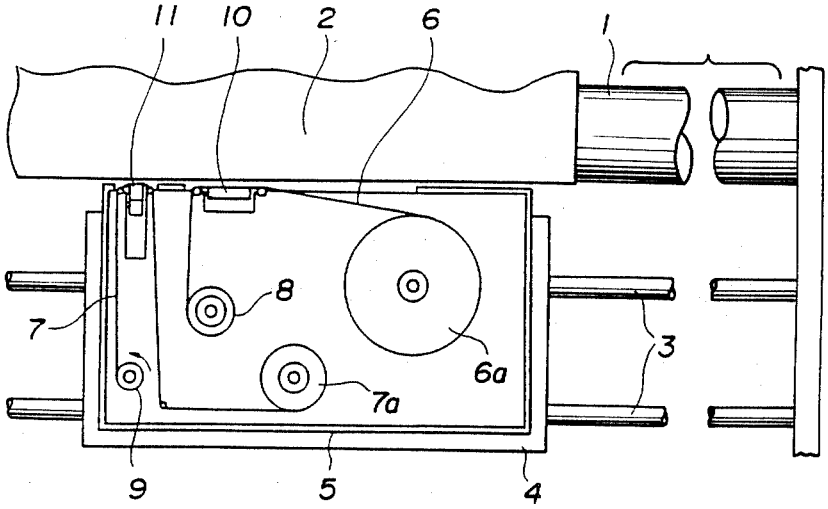
FIG. 2 is a similar view of the thermal transfer printer of FIG. 1, illustrating an erasing thermal head in its operative position.

FIGS. 1 and 2 are plan views showing a general construction of a thermal transfer printer according to the invention. FIG. 1 illustrates a condition during normal recording, and FIG. 2 illustrates another condition during erasing of a symbol printed in error.

Referring to FIGS. 1 and 2, reference numeral 1 designates a platen of a printer supported on side brackets 1*a*, 2 designates record paper which is fed along a predetermined path around an outer periphery of the platen 1, 3 designates a pair of guide shafts supported on the side brackets 1*a*, and 4 designates a carriage which is driven to reciprocate along the guide shafts 3.

A ribbon cassette 5 is removably mounted on the carriage 4 and has a printing transfer ribbon 6 and an erasing transfer ribbon 7 contained therein. The printing transfer ribbon 6 carries a layer of thermally fusible ink thereon and is held wound on a spool 6*a* while the erasing transfer ribbon 7 carries a layer of thermally adhesive resin material thereon and is held wound on a spool 7*a*. The printing transfer ribbon 6 is wound onto a printing ribbon take-up roller 8 while the erasing transfer ribbon 7 is wound onto an erasing ribbon take-up roller 9.

A printing thermal head 10 and an erasing thermal head 11 are mounted in a juxtaposed relationship at a front portion of the carriage 4, that is, a portion of the carriage 4 opposing to the record paper 2. Each of the printing thermal head 10 and the erasing thermal head 11 has a heat generating zone in which a plurality of heat generating resistor elements 10*a* and 11*a*, respectively, are disposed. The printing transfer ribbon 6 passes between the printing thermal head 10 and the record paper 2 while the erasing transfer ribbon 7 passes between the erasing thermal head 11 and the record paper 2. The thermal heads 10 and 11 are mounted for individual movement by a predetermined distance in directions as toward and away from the top or bottom of the drawing, and they are alternatively positioned to their operative positions adjacent the record paper 2. In particular, by means of controllably selecting the heads 10 or 11 for printing or erasing either the printing thermal head 10 is positioned to its operative position as seen in FIG. 1 or alternatively the erasing head 11 is positioned to its operative position as seen in FIG. 2. In the operative position of the printing thermal head 10, it presses the printing transfer ribbon 6 against the record paper 2, and in the operative position of the erasing thermal head 11, it presses the erasing transfer ribbon 7 against the record paper 2. It is to be mentioned here that the heat generating zone of the erasing thermal head 11 has a greater area than that of the printing thermal head 10.

Now, operation of the embodiment described above will be described.

When normal recording on the record paper 2 is to be effected, the printing thermal head 10 is moved to its operative position as shown in FIG. 1 to press the printing transfer ribbon 6 against the record paper 2 and is energized to generate heat while a winding driving force is applied to the printing ribbon take-up roller 8 within the ribbon cassette 5 to enable desired transfer recording. Meanwhile, the erasing thermal head 11 is held to an inoperative position in which it is spaced from the record paper 2 and is held deenergized to generate no heat while a winding driving force is not applied to the erasing ribbon take-up roller 9. In this condition, the thermally fusible ink on the printing transfer ribbon 6 is instantaneously melted by heat generated by the printing thermal head 10 and is transferred onto the record paper 2.

Figure 3:
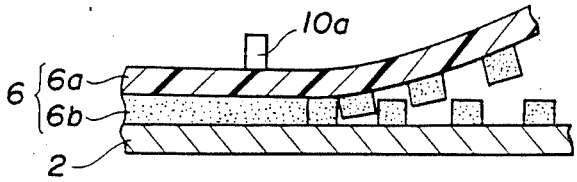
FIG. 3 is an enlarged sectional view illustrating a principle of transfer recording with thermal transfer ink onto record paper.

FIG. 3 is an enlarged sectional view illustrating a principle of such transfer recording. Referring to FIG. 3, the printing transfer ribbon 6 is shown which includes a base film 6*a* made of polyester or the like and a layer 6*b* of thermally fusible ink applied to the base film 6*a*. While the printing transfer ribbon 6 is held pressed against the record paper 2, it is heated by the heat generating resistor elements 10*a* of the printing thermal head 10 so that the thermally fusible ink layer 6*b* on a heated portion of the printing transfer ribbon 6 is meltedand transferred onto the record paper 2. Accordingly, by selectively controlling the heat generating zone of the printing thermal head 10 and controlling the carriage 4 to move along the guide shafts 3, desired characters, marks, numerals and the like can be printed or recorded on the record paper 2.

Meanwhile, in case a symbol has been printed in error, at first the carriage 4 is controlled to move to a position in which the erasing thermal head 11 is opposed to the symbol printed in error with the erasing transfer ribbon 7 interposed therebetween. Then, the erasing thermal head 11 is shifted to its operative position as shown in FIG. 2 to press the erasing transfer ribbon 7 against the record paper 2, and then it is energized to generate heat while a winding driving force is applied to the erasing ribbon take-up roller 9 within the ribbon cassette 5 to enable desired lifting off. Meanwhile, the printing thermal head 10 is held to an inoperative position in which it is spaced from the record paper 2 and is held deenergized to generate no heat while no winding driving force is applied to the printing ribbon take-up roller 8. In this condition, the thermally fusible resin material on the erasing transfer ribbon 7 is melted by heat generated by the erasing thermal head 11 and adheres to the symbol printed in error on the record paper 2. As a result, after the thermally adhesive resin material has become cool, the ink of the symbol printed in error is exfoliated from the record paper 2 and thus erased.

Figure 4:
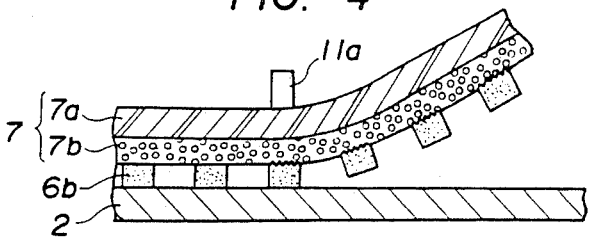
FIG. 4 is a similar view illustrating a principle of lifting off of thermal transfer ink from record paper.

FIG. 4 is an enlarged sectional view illustrating such a lift off principle. Referring to FIG. 4, the erasing transfer ribbon 7 is shown which includes a base film 7*a* made of polyester or the like and a layer 7*b* of thermally adhesive resin applied to the base film 7*a*. While the erasing transfer ribbon 7 is held pressed against the record paper 2, it is heated by the heat generating resistor elements 11*a* of the erasing thermal head 11 so that the thermally adhesive ink layer 7*b* on a heated portion of the erasing transfer ribbon 7 is melted and adheres to the thermally fusible ink layer 6*b* on the record paper 2. Here, the affinity between the base film 7*a* and the thermally adhesive resin layer 7*b* and the affinity between the thermally adhesive resin layer 7*b* and the thermally fusible ink layer 6*b* are both greater than the affinity between the thermally fusible ink layer 6*b* and the record paper 2. Accordingly, if generation of heat by the erasing thermal head 11 is stopped to allow the thermally adhesive resin layer 7*b* already adhered to the thermally fusible ink layer 6*b* on the record paper 2 to become cool and then the erasing transfer ribbon 7 is spaced away from the record paper 2, the thermally fusible ink layer 6*b* by which the symbol printed in error has been provided is exfoliated from the record paper 2, thus completing lift-off of the symbol printed in error.

In this case, since the heat generating zone of the erasing thermal head 11 has a greater heat generating area than that of the printing thermal head 10, there is little possibility that the symbol printed in error be left unerased as described below.

Figure 5:
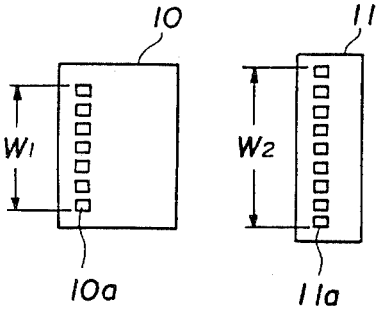
FIG. 5 is a diagrammatic representation of heat generating element arrangements on the printing and erasing thermal heads for comparison therebetween.
Figure 6:
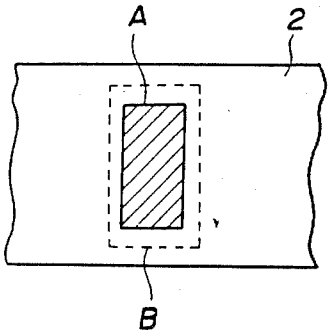
FIG. 6 is a diagrammatic representation illustrating recording and erasing areas provided by the printing and erasing thermal heads for comparison therebetween.

FIG. 5 is a diagrammatic representation illustrating an area of the heat generating zone of the erasing thermal head 11 in comparison with that of the printing thermal head 10, and FIG. 6 is another diagrammatic representation illustrating a relationship between a transfer area for recording and another transfer area for erasing on the record paper 2. Referring to FIG. 5, the heat generating zone of each of the printing and erasing thermal heads 10 and 11 includes a plurality of heat generating resistor elements 10*a* or 11*a* disposed in a row extending in a direction of the height of a symbol to be printed, and the width W2 of the heat generating zone of the erasing thermal head 11 is greater than the width W1 of the heat generating zone of the printing thermal head 10 ($W1 < W2$). Accordingly, upon normal printing, the thermally fusible ink layer 6*b* of the printing transfer ribbon 6 will be transferred within a region A as hatched in FIG. 6, and yet upon erasing of a symbol printed in error, the thermally adhesive resin layer 7*b* of the erasing transfer ribbon 7 is applied or adhered within a region B as shown by broken lines in FIG. 6. Thus, since the region B for erasing completely contains or encircles therein the transfer region A for printing, there remains little or no possibility that a symbol printed in error be left unerased.

It is to be noted that in order to complete an intended correcting operation, naturally a desired character, mark or the like may be transfer recorded, using the printing transfer ribbon 6 and the printing thermal head 10, at the location on the record paper 2 from which the symbol has been erased.

As apparent from the foregoing description, according to the present invention, an erasing thermal head having a greater heat generating area than a printing thermal head can be operated to press an erasing transfer ribbon carrying a layer of thermally adhesive resin material thereon against record paper and be energized to generate heat to effect desired lift-off or removal of a printed symbol. Accordingly, a symbol such as a character or a mark printed in error on record paper can be simply and assuredly erased. As a result, inefficient correcting operations such as hand rewriting can be eliminated.

What is claimed is:

1. In a thermal transfer printer of the type which includes a printing transfer ribbon carrying a layer of thermally fusible ink thereon, a movable carriage, and a printing thermal head mounted on said carriage and operable to generate heat to melt the thermally fusible ink on said printing transfer ribbon to effect transfer recording on record paper, the improvement which comprises an erasing ribbon carrying thereon a layer of a thermally adhesive resin material for lifting off the thermally fusible ink of a symbol printed in error on the record paper, and an erasing thermal head mounted on said carriage and having a heat generating area greater than that of said printing thermal head, said erasing thermal head and said printing thermal head being disposed in a juxtaposed relationship in a direction of movement of said carriage, whereby, during normal recording, said printing thermal head is operated to generate heat to melt the thermally fusible ink on said printing transfer ribbon to effect desired printing by transfer of the ink, but during erasing of a symbol printed in error with the thermally fusible ink, said erasing thermal head is operated to generate heat to melt the thermally adhesive resin on said erasing ribbon sufficient to adhere to the thermally fusible ink of the symbol printed in error to lift off the ink from the record paper.

2. A thermal transfer printer according to claim 1, wherein said printing thermal head and said erasing thermal head are alternatively positioned to an operative position thereof in which said printing or erasing thermal head presses said printing thermal ribbon or said erasing ribbon against the record paper.

3. A thermal transfer printer according to claim 1, further comprising a ribbon cassette in which both said printing transfer ribbon and said erasing ribbon are contained, said ribbon cassette being removably mounted on said carriage.

* * * * *